US009511272B2

(12) United States Patent
Lowe et al.

(10) Patent No.: US 9,511,272 B2
(45) Date of Patent: Dec. 6, 2016

(54) HELMET FOR BASEBALL PITCHERS AND FIELDERS

(75) Inventors: Mike Lowe, Santa Cruz, CA (US); Chris Bullock, Campbell, CA (US); Donald Erickson, Saratoga, CA (US)

(73) Assignee: EASTON BASEBALL/SOFTBALL INC., Thousand Oaks, CA (US)

( * ) Notice: Subject to any disclaimer, the term of this patent is extended or adjusted under 35 U.S.C. 154(b) by 0 days.

(21) Appl. No.: 13/096,909

(22) Filed: Apr. 28, 2011

(65) Prior Publication Data

US 2011/0271430 A1 Nov. 10, 2011

Related U.S. Application Data

(60) Provisional application No. 61/444,032, filed on Feb. 17, 2011, provisional application No. 61/331,362, filed on May 4, 2010.

(51) Int. Cl.
*A63B 71/10* (2006.01)
*A42B 3/18* (2006.01)

(52) U.S. Cl.
CPC ..... *A63B 71/10* (2013.01); *A42B 3/18* (2013.01); *A63B 2102/18* (2015.10)

(58) Field of Classification Search
CPC ..... A42B 3/32; A42B 3/328; A42B 3/00; A42B 3/068; A42B 3/067; A63B 71/10
USPC ..... 2/410, 411, 414, 421, 424, 425
See application file for complete search history.

(56) References Cited

U.S. PATENT DOCUMENTS 1,537,178 A * 5/1925 Maynard ..... 2/421
3,087,166 A 4/1963 Howard
3,984,875 A 10/1976 Farquharson
4,404,690 A * 9/1983 Farquharson ..... 2/420
4,477,929 A * 10/1984 Mattsson ..... 2/425
4,646,367 A * 3/1987 El Hassen ..... A42B 3/00 2/171
5,012,533 A * 5/1991 Raffler ..... A42B 3/066 2/420
5,381,560 A 1/1995 Halstead
5,515,546 A * 5/1996 Shifrin ..... A42B 3/00 2/209.11
6,154,889 A * 12/2000 Moore et al. ..... 2/418
6,701,535 B2 * 3/2004 Dobbie et al. ..... 2/422
(Continued)

FOREIGN PATENT DOCUMENTS

| | | | |
|---|---|---|---|
| CA | 494368 | A | 7/1953 |
| CN | 1913796 | A | 2/2007 |
| JP | 2002-58773 | A | 2/2002 |
| TW | 492848 | | 7/2002 |
| TW | M247024 | | 10/2004 |

OTHER PUBLICATIONS

American Heritage® Dictionary of the English Language, Fifth Edition. Copyright © 2011 by Houghton Mifflin Harcourt Publishing Companyhttp://www.thefreedictionary.com/strap.*
(Continued)

*Primary Examiner* — Shaun R Hurley
*Assistant Examiner* — Andrew W Sutton
(74) *Attorney, Agent, or Firm* — Perkins Coie LLP

(57) ABSTRACT

A helmet for baseball pitchers and fielders includes features to protect a player's head and face from being struck by a batted ball. The helmet optionally includes side protection, which may include cheek, jaw, temple, or chin protection. The helmet also may optionally include a face mask. The helmet may be used in lacrosse and other sports, as well.

19 Claims, 8 Drawing Sheets

(56) References Cited

U.S. PATENT DOCUMENTS

| | | | | |
|---|---|---|---|---|
| 6,711,751 | B1 | 3/2004 | Muskovitz | |
| 6,938,272 | B1 * | 9/2005 | Brown | 2/9 |
| 2002/0007508 | A1 * | 1/2002 | Grepper et al. | 2/420 |
| 2004/0025231 | A1 * | 2/2004 | Ide et al. | 2/425 |
| 2004/0250340 | A1 | 12/2004 | Piper et al. | |
| 2007/0220662 | A1 | 9/2007 | Pierce | |
| 2009/0178184 | A1 | 7/2009 | Brine, III et al. | |
| 2009/0265841 | A1 * | 10/2009 | Ferrara | 2/421 |
| 2010/0229285 | A1 * | 9/2010 | Kindermann | 2/410 |
| 2012/0260405 | A1 | 10/2012 | Shen | |

OTHER PUBLICATIONS

International Search Report and Written Opinion dated Jul. 18, 2011 in corresponding PCT application No. US2011/034646.

State Intellectual Property Office (China), First Office Action for CN 201180033323.5, May 28, 2014 (with English translation).

Taiwan Patent Office, Search Report for TW 100114122, Nov. 7, 2013.

State Intellectual Property Office, PRC China, the Third Office Action for CN 201180033323.5, mailed Oct. 9, 2015, with English translation, Oct. 9, 2015, 13 pgs.

European Patent Office, Extended European Search Report for EP11778066.8, Nov. 24, 2014.

State Intellectual Property Office (PRC China), Second Office Action for CN201180033323.5 (with English Translation), Jan. 27, 2015.

* cited by examiner

HELMET FOR BASEBALL PITCHERS AND FIELDERS

PRIORITY CLAIMS

This application claims priority to U.S. Provisional Patent Application No. 61/444,032, filed Feb. 17, 2011, and U.S. Provisional Patent Application No. 61/331,362, filed May 4, 2010, both of which are incorporated herein by reference.

BACKGROUND OF THE INVENTION

Baseball regulatory associations have increasingly been imposing safety regulations to protect the welfare of players. For example, many associations have placed a limit on the allowable ball bat coefficient of restitution ("BBCOR") of a ball bat, which limits the maximum rebound speed of a batted ball. Pitchers, due to their proximity to batters and their sometimes awkward positioning after a follow-through, are particularly susceptible to being struck by a batted ball.

BRIEF SUMMARY OF THE INVENTION

A helmet for baseball pitchers and fielders includes features to protect a player's head and face from being struck by a batted ball. The helmet optionally includes side protection, which may include cheek, jaw, temple, or chin protection. The helmet also may optionally include a face mask. Other features and advantages appear hereinafter. The features described herein can be used separately or together, or in various combinations of one or more of them.

BRIEF DESCRIPTION OF THE DRAWINGS

In the drawings, wherein the same reference number indicates the same element throughout the views.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Figure 1:
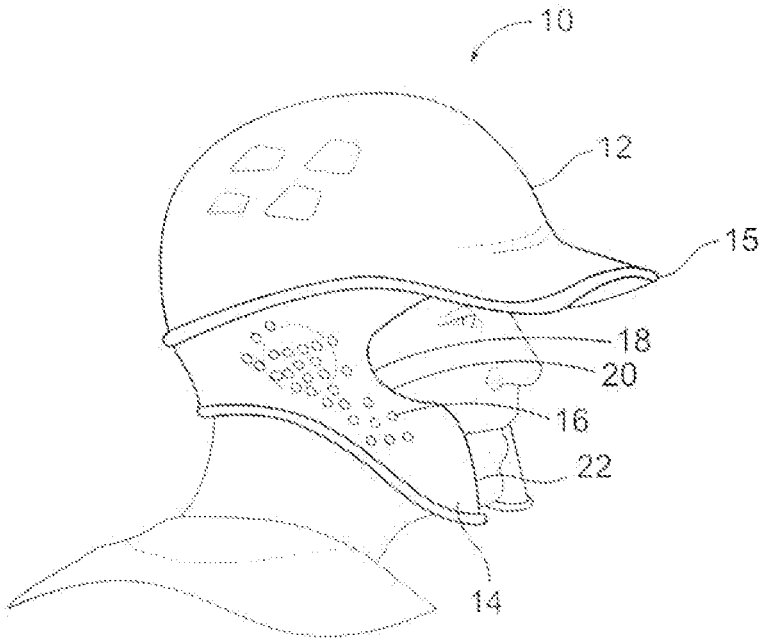
FIG. 1 is a perspective view of a two-piece pitcher's or fielder's helmet according to one embodiment.

Turning now in detail to the drawings, as shown in FIG. 1, a pitcher's or fielder's helmet 10 (hereinafter referred to as a "pitcher's helmet," for ease of reference), according to one embodiment, includes an upper shell 12 attached to a lower protective element 14. The upper shell 12 may be removably or permanently attached to the lower protective element 14. In one embodiment, the upper shell 12 includes a first male or female attachment element for engaging a corresponding second female or male attachment element on the lower protective element 14. For example, the upper shell 12 may include a female receiving element and the lower protective element 14 may include a male tab that can be inserted into the female receiving element. The upper shell 12 may alternatively be attached to the lower protective element 14 via snaps, screws, bolts, locking joints, or in any other suitable manner. The upper shell 12 optionally includes a traditional baseball helmet brim 15 or similar feature for shielding the sun from the wearer's eyes.

The upper shell 12 may be made of polycarbonate or another suitable material. The upper shell 12 may optionally be insert molded with an inner padding layer of EPS (expanded polystyrene), EPP (expanded polypropylene), EPE (expanded polyethylene), or another suitable energy-absorbing material, or may be injection molded and lined with such a padding. Insert molding generally allows for a lighter and thinner helmet than does a conventional injection molding process. In one embodiment, the upper shell 12 may be a hybrid including injection molded portions and insert molded portions.

The lower protective element 14 may be made of a rigid material such as polycarbonate, or may alternatively be made of a more flexible material such as a soft TPU (thermoplastic polyurethane) or another flexible plastic. The lower protective element 14, like the upper shell 12, may be injection molded and lined with a suitable padding material, or may be insert molded with an inner padding layer of EPS, EPP, EPE, or another suitable energy-absorbing material, or may be a hybrid of both. The lower protective element 14 optionally includes openings 16 for providing ventilation and cooling.

The lower protective element 14 may optionally be conformable to a wearer's face (or close to a wearer's face) to minimize the likelihood it will contact the wearer's shoulder or other body parts during the pitching motion. The use of a relatively soft material, such as a soft TPU, may be beneficial for this purpose, since it is able to flex if it comes into contact with the wearer. In another embodiment, a flexible lower edge may be included on a relatively rigid lower protective element 14 to provide a similar benefit.

The lower protective element 14 may extend to cover a variety of regions of a wearer's head or face. For example, the lower protective element 14 may cover a typical wearer's ears, cheeks, portions of the lower jaw, or chin. The extent of coverage could optionally vary between models or by wearer preference, or could be dictated by particular association regulations.

The lower protective element 14 optionally includes a cutback 18 or cutaway region adjacent a wearer's eyes to provide unobstructed peripheral vision to the wearer. As a pitcher's head typically is turned sideways relative to home plate at some point during the windup, having unobstructed peripheral vision may be important for many pitchers. Such a feature also provides pitchers with better views of bases and base runners, allowing pitchers to effectively execute "pick-off" plays. The lower protective element 14 optionally includes an upper edge 20 inclined from its front edge 22. Such a configuration can provide unobstructed peripheral vision while still covering a substantial portion of the wearer's cheeks and face.

Figure 2:
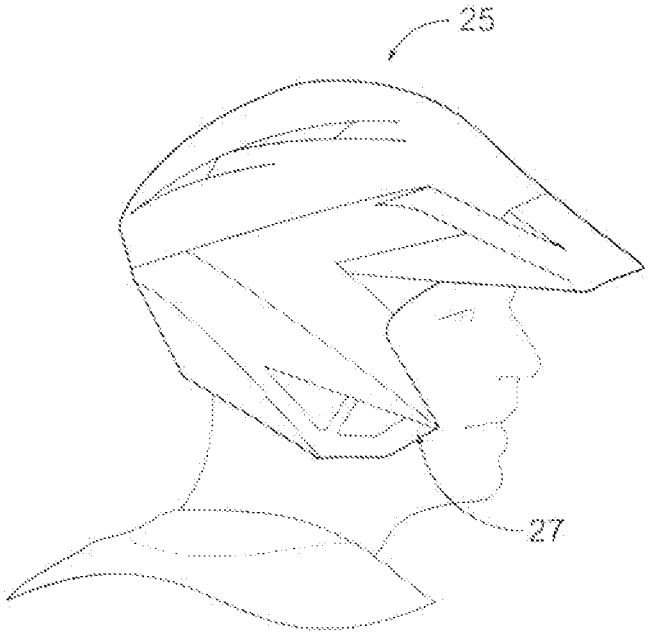
FIG. 2 is a perspective view of a one-piece pitcher's or fielder's helmet according to one embodiment.

FIG. 2 depicts an alternative one-piece pitcher's helmet 25 including an angular jaw flap 27. The one-piece helmet 25 may be made of polycarbonate or another suitable material. The one-piece helmet 25 may be injection molded and lined with a suitable padding, or may be insert molded with an inner padding layer of EPS, EPP, EPE, or another suitable energy-absorbing material, or may be a hybrid of both. The extent of coverage of the jaw flap 27 may vary between models or by wearer preference, or could be dictated by particular association regulations. For example, the jaw flap 27 may optionally cover a typical wearer's cheeks, portions of the lower jaw, or chin.

Figure 1A:
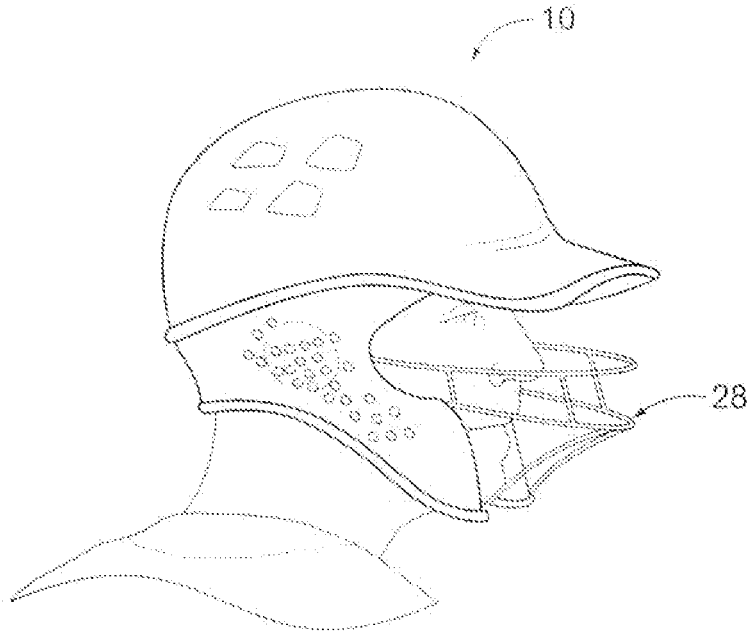
FIG. 1A is a perspective view of the helmet shown in FIG. 1 including a face mask, according to one embodiment.
Figure 2A:
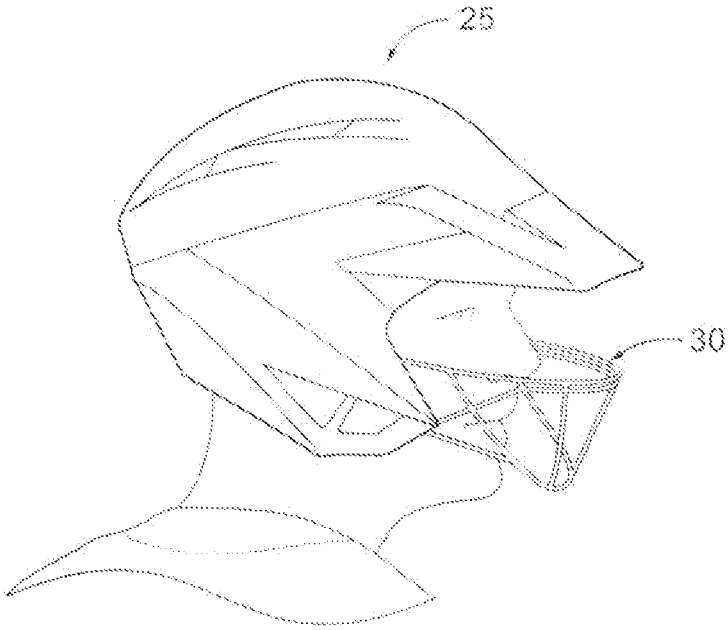
FIG. 2A is a perspective view of the helmet shown in FIG. 2 including a face mask, according to one embodiment.

FIGS. 1A and 2A illustrate the helmets 10 and 25 of FIGS. 1 and 2, respectively, with face masks 28 and 30, made of wire or other suitable materials, attached to the helmets. The face masks 28 and 30 may be attached by plastic straps or other suitable connectors. The face masks 28 and 30 may be removably or permanently attached to the helmets 10 and 25. Whether a face mask is included may generally be dictated by a wearer's preference or association regulations.

In one embodiment, a face mask may be molded or "overmolded" with the impact liner or padding in the helmet. Doing so would reduce or eliminate the need for separate face mask attachment mechanisms, which would reduce the overall weight of the helmet and provide additional structure to the impact-absorbing material.

FIGS. 3-9 illustrate alternative embodiments of pitcher's helmets including a variety of features, many of which are identified in the drawings. These helmets may include any of the features of the helmets shown in FIGS. 1, 1A, 2, and 2A, as long as those features are not inconsistent with other features of the alternative embodiments. A more detailed description of some of the features of the alternative embodiments follows.

Figure 3:
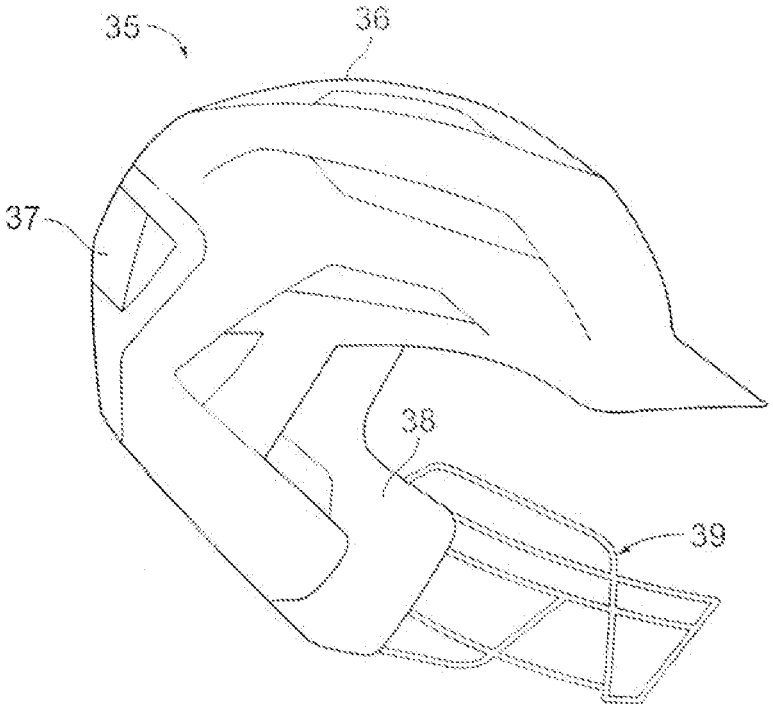
FIG. 3 is a perspective view of another embodiment of a pitcher's or fielder's helmet including a hinged back plate.

FIG. 3 illustrates a helmet 35 that includes, among other things, a hinged back plate 37 at the rear of the helmet 35. The back plate 37 preferably includes a hinge along its upper edge such that the lower portion of the back plate 37 may be pivoted away from the remainder of the helmet shell, thus loosening the helmet for quick removal. This may be a desirable feature for many players who prefer to remove their helmets to provide a better field of vision when fielding pop-ups or fly balls, for example. The back plate 37 may optionally be "nested" such that its outer surface is flush or substantially flush with adjacent outer surfaces of the helmet 35. The back plate 37 may also include openings to provide increased ventilation. The helmet 35 optionally includes an insert molded top section 36 and a hard lower shell 38 that allows for effective mounting of a face mask 39.

Figure 4:
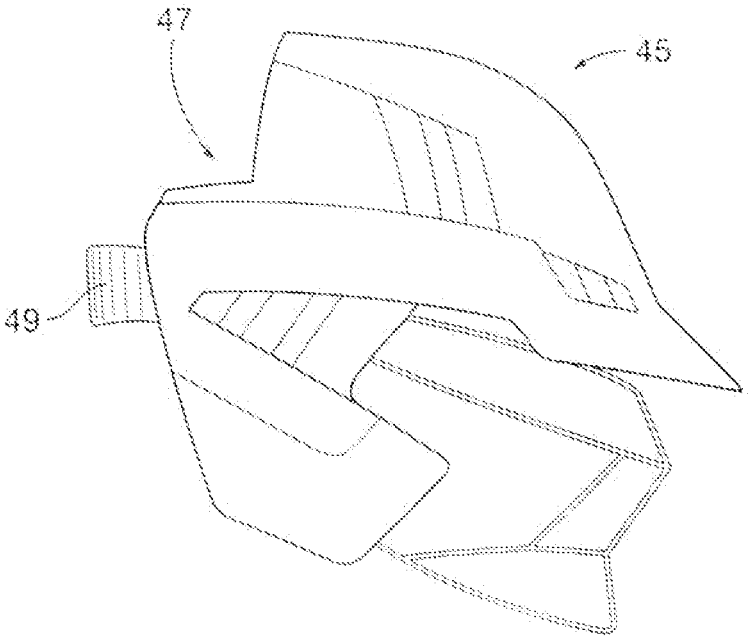
FIG. 4 is a perspective view of another embodiment of a pitcher's or fielder's helmet including a rear strap.

FIG. 4 illustrates a helmet 45 that includes, among other things, an open rear section 47. The helmet 45 is less restrictive and generally has a lighter weight than a similar full or "closed" helmet. The helmet 45 also provides improved ventilation to help keep the wearer cool. A strap 49 or other suitable attachment element is included for removably securing the helmet to the wearer. Such a lightweight helmet may be desirable for many players, as it is generally believed that the incidence of ball impacts to the top or rear of a wearer's head is relatively low due to typical player positioning and reaction time.

Figure 5:
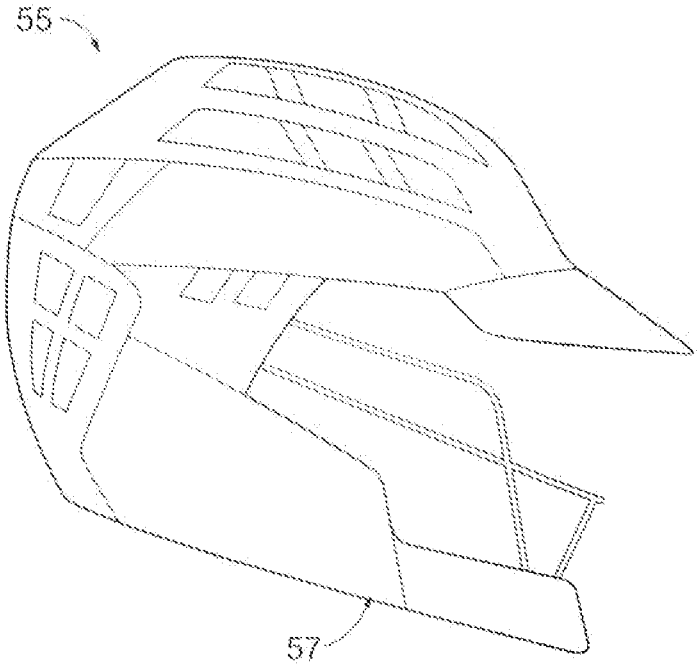
FIG. 5 is a perspective view of another embodiment of a pitcher's or fielder's helmet including a hinged back plate and an extended jaw protector.

FIG. 5 illustrates a helmet 55 that includes, among other things, an extended jaw flap 57 or jaw protector that provides increased cheek, jaw, and chin protection. The jaw flap 57 may optionally be a single piece that extends all the way around the front of a wearer's face. Alternatively, a separate jaw flap may be included on each side of the helmet, with each jaw flap terminating along the side or the front of the wearer's jaw or chin.

Figure 6:
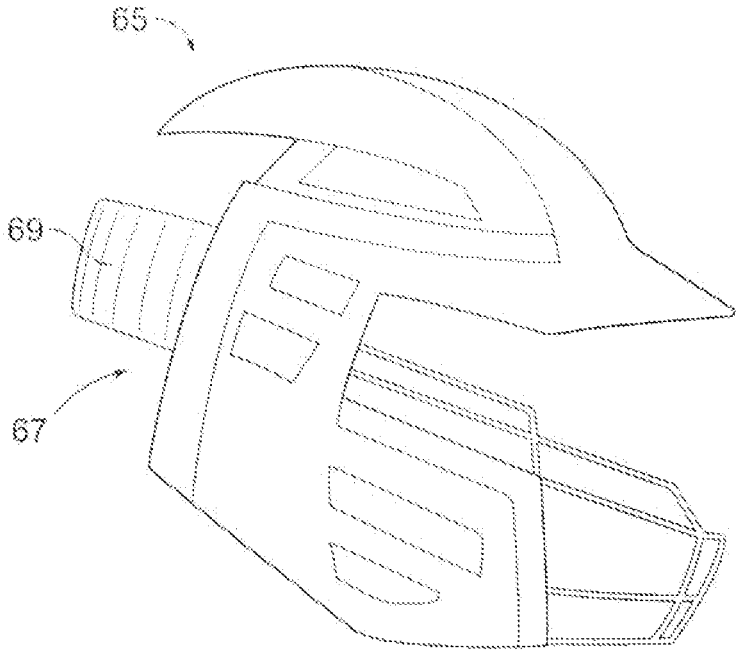
FIG. 6 is a perspective view of another embodiment of a pitcher's or fielder's helmet including a back plate in conjunction with a reduced rear section.

FIG. 6 illustrates a helmet 65 that includes, among other things, a reduced rear section 67 and a back plate 69 at the rear of the helmet. The back plate 69 may be hinged, allowing for quick removal of the helmet, as described above.

Figure 7:
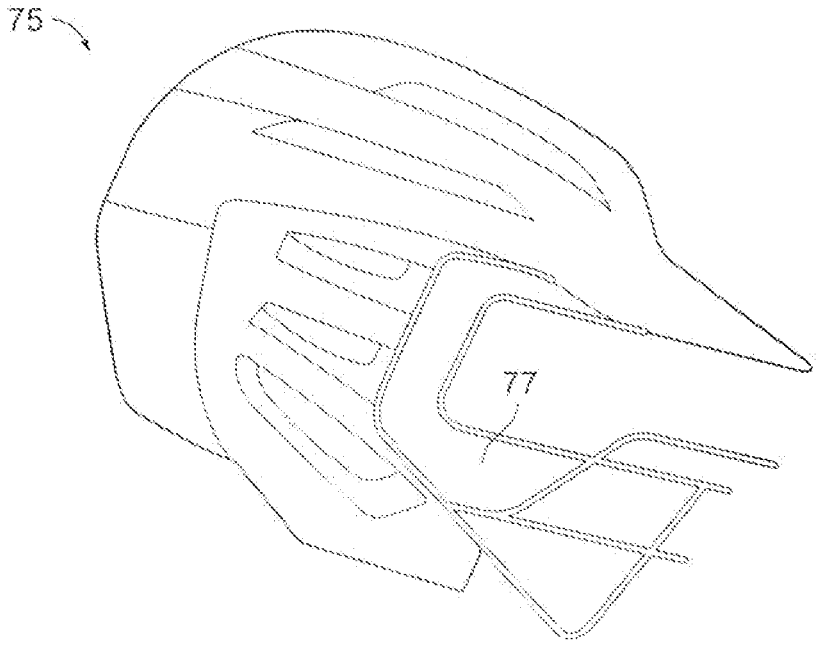
FIG. 7 is a perspective view of another embodiment of a pitcher's or fielder's helmet including an anti-reflective or "anti-glare" coating.

FIG. 7 illustrates a helmet 75 that includes, among other things, an anti-reflective or "anti-glare" coating 77 (or anti-glare material), such as a layer of anti-glare paint, surrounding the facial region. Such a coating helps reduce the glare resulting from sunlight, for example.

Figure 8:
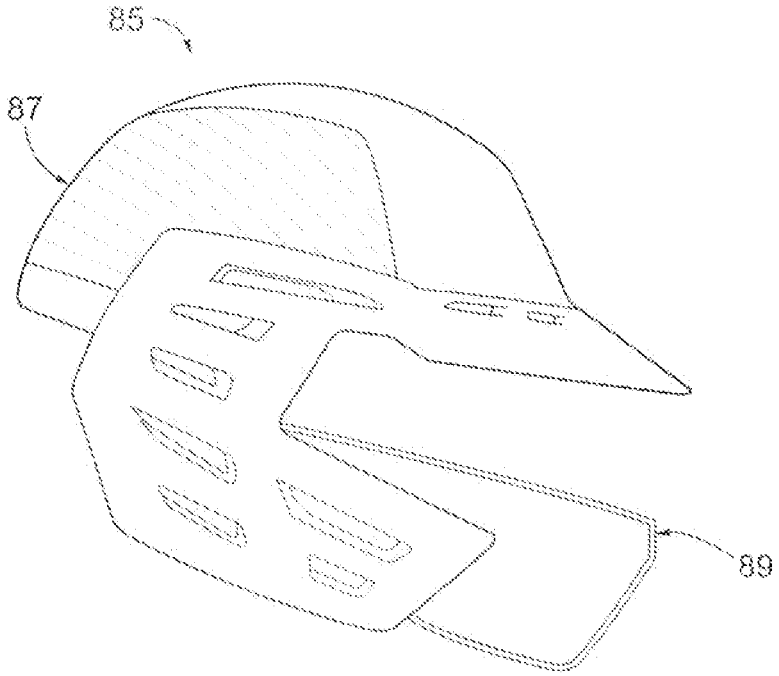
FIG. 8 is a perspective view of another embodiment of a pitcher's or fielder's helmet including a soft rear portion made of a fabric.

FIG. 8 illustrates a helmet 85 that includes, among other things, a soft rear portion 87 made of a fabric, such as wool, for example. Including such a fabric has unexpectedly been found to wick sweat from the wearer's head to the exterior of the fabric. Such a wicking fabric provides increased heat dissipation and cooling for the wearer. The helmet 85 optionally includes a face mask 89, such as a clear, polycarbonate face mask, or a face mask made of any other suitable material.

Figure 9:
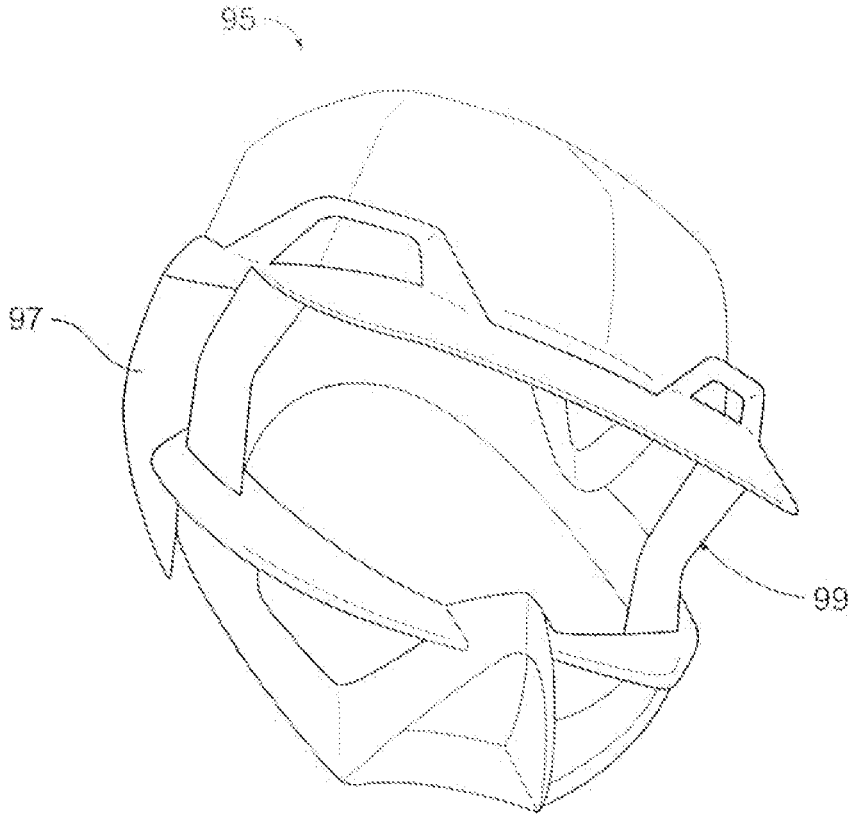
FIG. 9 is a perspective view of another embodiment of a pitcher's or fielder's helmet that fits over a ball cap and includes a face mask.

FIG. 9 illustrates a helmet 95 that, among other things, fits over a standard ball cap. Such a helmet 95 preferably includes hard-shell ear pads 97 to protect the ears and optionally portions of the cheeks of the wearer. The helmet 95 also may include a face mask 99.

Figure 10:
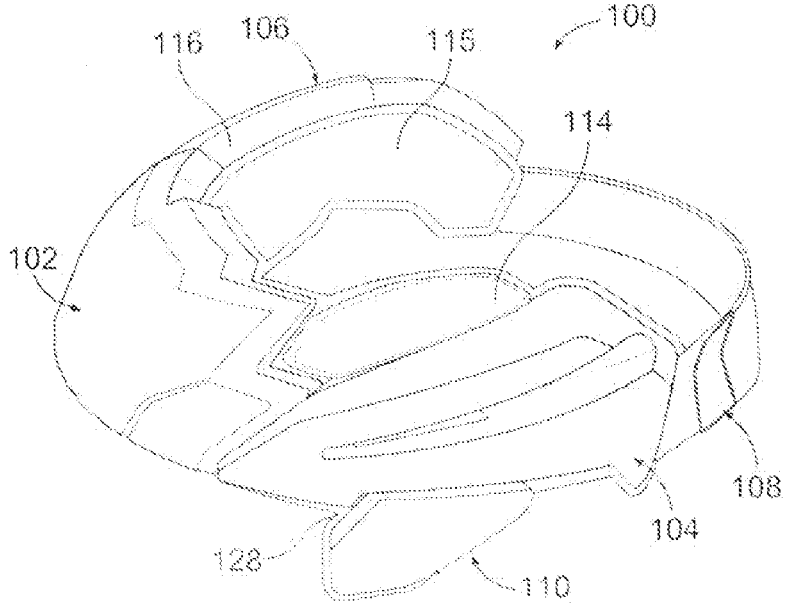
FIG. 10 is a perspective view of another embodiment of a pitcher's or fielder's helmet that fits over a ball cap and includes pads for protecting the temple regions and forehead of the wearer.
Figure 10A:
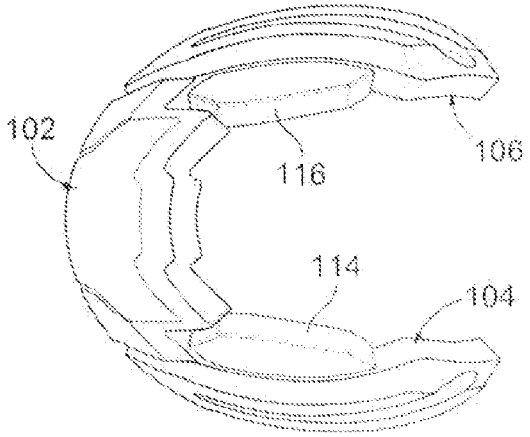
FIG. 10A is a top view of the helmet shown in FIG. 10.
Figure 10B:
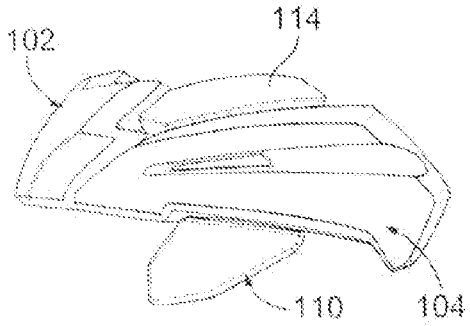
FIG. 10B is a side view of the helmet shown in FIG. 10.
Figure 10C:
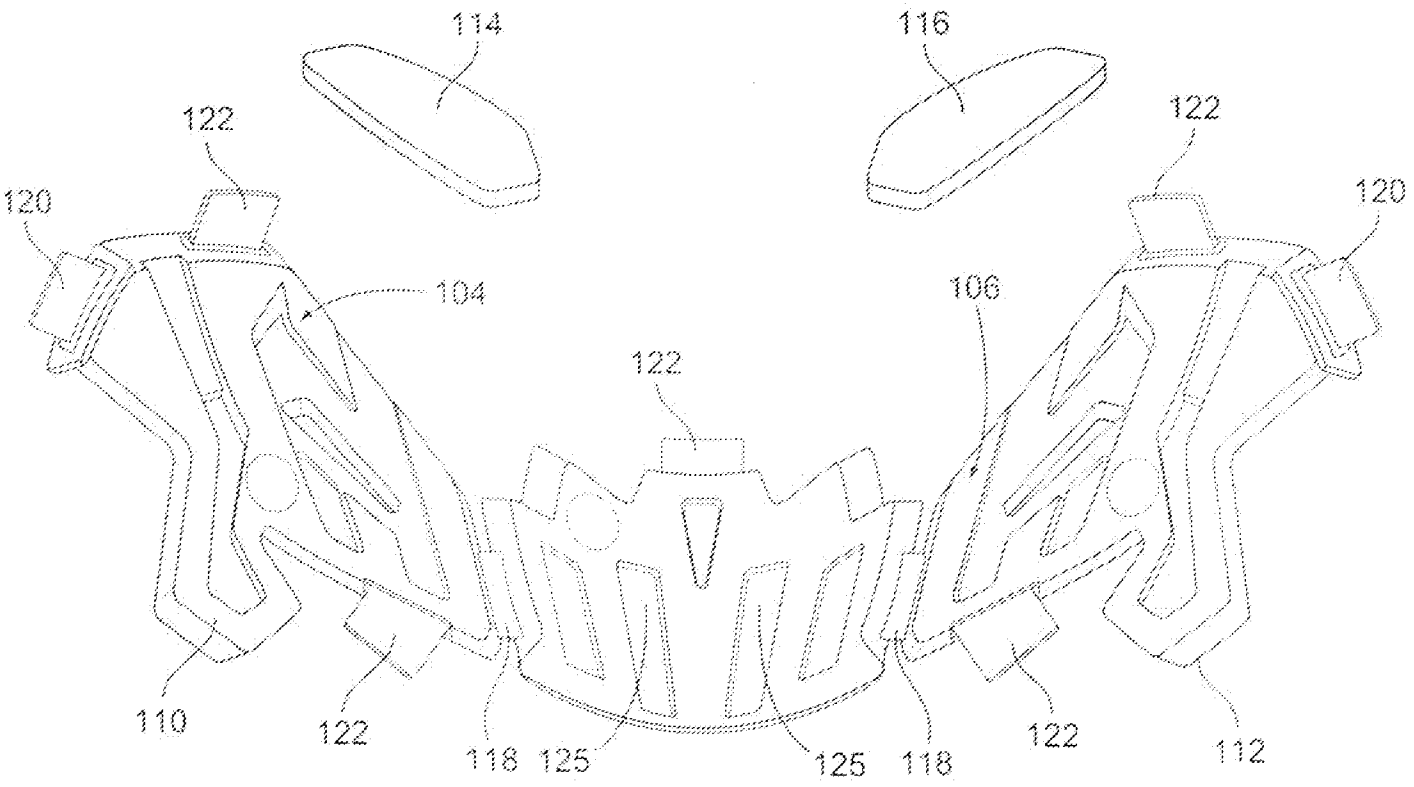
FIG. 10C is a perspective view of the shell components of the helmet shown in FIG. 10.

FIGS. 10-10C illustrate a piece of headgear or a helmet 100 that fits over a standard ball cap, or that may be worn directly on a wearer's head. The helmet 100 includes a shell having a front component 102 and two side components 104, 106. A preferably adjustable backstrap 108 is connected to the side components 104, 106. Temple guards 110. 112 depend downwardly from the side components 104, 106, respectively. The temple guards 110, 112 may be integral portions of, or may be separately attached to, the side components 104, 106.

An interior liner or one or more layers of comfort padding 115, such as open-cell foam padding, are preferably included on an interior of the shell to provide comfort for a wearer. Comfort padding 115 is preferably included on all of the shell regions that engage a wearer's head but such padding is not required.

Upper components 114, 116 may optionally be included for additional protection to the sides of a wearer's head. The upper components 114, 116 may be encased in fabric and sewn to the comfort padding 115 above the side components 104, 106, or may be attached to or integral with the side components 104, 106 or the front component 102. To increase comfort and reduce weight relative to a full-shell helmet, the helmet 100 preferably does not include a top component.

The shell components may be made of EPS, EPP, EPE, or of another energy-absorbing material. EPS has been found to work particularly well for absorbing energy in baseball and softball impact applications. One or more of the shell components may be covered with, or encased in, a thin sheet of polycarbonate or a similar material to provide strength to the pad structure. In one exemplary embodiment, the front and side shell components are made of EPS that is in-molded with a thin outer layer or exoskeleton of polycarbonate, and may have a total thickness of approximately 18-20 mm.

In one embodiment, the front component 102 is attached to the side components via straps 118 that are in-molded with the front and side components. The straps 118 may be made of a mesh material, such as a polypropylene mesh, or of another suitable material. Connecting the front and side components via straps provides for improved fit, and thus improved and targeted impact attenuation, over a wide range of head sizes. Other shell components may optionally be connected to each other via straps, as well.

Additional straps 120 may be in-molded with the side components 104, 106 and sewn or otherwise attached to the backstrap 108. The backstrap 108 may alternatively be connected to the side components 104, 106 in any other suitable manner. Further straps 122 may be in-molded with the front component 102 or the side components 104, 106 and sewn to the comfort padding 115 to secure the padding to the helmet shell. The comfort padding 115 may alternatively be connected to the shell in any other suitable manner.

The front component 102 and side components 104, 106 optionally include internal grooves or channels 125 that provide fracture zones in the helmet 100. These fracture zones generally are the first regions to fracture or to otherwise exhibit damage upon a significant impact, which provides an indication to a user that the helmet (or the fractured region of the helmet) should be replaced. The channels 125 preferably have relatively sharp or angled corners—as opposed to rounded corners—which result in defined or noticeable fractures upon a significant impact. The inclusion of the channels 125 causes the shell components to better attenuate energy and therefore allows them to be significantly thinner than shells not including channels. It has been found, for example, that shell components including channels 125, as shown in FIG. 100, are able to attenuate energy as well as shells that are approximately 1.5 times thicker but do not include channels.

Energy-absorbing pads 128 may optionally be connected to the interior of the temple guards 110, 112. The temple pads 128 may be detachably connected via hook-and-loop fasteners, snaps, or other suitable connectors, or may otherwise be suitably attached to or integral with the temple guards 128. The temple pads 128 may be made of an energy-absorbing PVC nitrile foam, or an energy-absorbing polyurethane foam, or another suitable energy-absorbing material. The temple pads 128 provide increased energy absorption for protection of the temple region of the wearer's head. The temple pads 128 optionally include an inner layer of a softer, comfort padding to provide comfort for the wearer.

In any of the above described embodiments, an energy-absorbing material, such as EPS, EPP, EPE, or another suitable material, may be included in a variety of helmet regions. For example, such a material may be molded with or otherwise attached or bonded to portions of the inner shell covering various portions of a wearer, such as the top of the head, the sides of the head, the rear of the head, portions of the neck, the ears, the cheeks, portions of the lower jaw, or the chin. This energy-absorbing material dissipates energy when the helmet is struck with a batted or thrown ball, thus minimizing the amount of impact force absorbed by the wearer.

The energy absorbing material may optionally be covered with or encased in a sheet of polycarbonate or a similar material to provide strength to the pad structure. One or more fitting or comfort foams may also be included in the pad structure, preferably between the energy foam or other energy-absorbing material and the wearer, to provide a more comfortable fit for the wearer. In some embodiments, certain interior regions of the helmet may include pads having only comfort foam, such as rear or top regions of the helmet less likely to be struck by a batted ball, for example.

While the helmets described herein are primarily intended to be worn by baseball pitchers or fielders, batters and catchers could conceivably also where one or more of the helmets. Players in other sports, such as lacrosse, cycling, hockey, and so forth, may also wear the helmets.

Any of the above-described embodiments may be used alone or in combination with one another. Furthermore, a pitcher's helmet may include additional features not described herein. While several embodiments have been shown and described, various changes and substitutions may of course be made, without departing from the spirit and scope of the invention. The invention, therefore, should not be limited, except by any claims and their equivalents.

What is claimed is:

1. Sports headgear, comprising:

a front shell component including at least one front internal channel that provides a fracture zone, wherein the front internal channel does not pass all the way through the front shell component;

at least two side shell components attached to or integral with the front shell component, wherein the side shell components each include at least one side internal channel that provides a fracture zone, and wherein the side internal channels do not pass all the way through the side shell components;

a rear strap connected to the two side shell components; and a temple guard depending downwardly from each of the two side shell components;

wherein the headgear comprises an open top configured to expose a top of a wearer's head when the wearer is wearing the headgear.

2. The headgear of claim 1 wherein each of the channels includes angled corners.

3. Sports headgear, comprising:

a front shell component;

at least two separate side shell components attached to the front shell component via flexible straps;

at least one channel in each of the front and side shell components, wherein each of the channels provides a fracture zone; and a temple guard depending downwardly from each of the two side shell components.

4. The headgear of claim 3 wherein each of the channels includes angled corners.

5. The headgear of claim 3 wherein the thickness of the front and side shell components is approximately 18 to 20 mm.

6. The headgear of claim 3 wherein the front and side shell components comprise expanded polystyrene.

7. The headgear of claim 6 wherein the expanded polystyrene shell components are in-molded with an outer layer of polycarbonate.

8. The headgear of claim 7 wherein the total thickness of the front and side shell components is approximately 18 to 20 mm.

9. The headgear of claim 3 wherein the straps that attach the front shell component to the side shell components are in-molded with the front and side shell components.

10. The headgear of claim 3 further comprising an energy-absorbing pad on an interior surface of each of the temple guards.

11. The headgear of claim 10 wherein each of the energy-absorbing pads includes an inner layer of comfort padding.

12. The headgear of claim 3 further comprising a liner of comfort padding attached to an interior of the front and side shell components.

13. The headgear of claim 12 wherein the liner of comfort padding is attached to the front and side shell components via straps that are in-molded with the front and side shell components.

14. The headgear of claim 3 further comprising a rear strap connected to the two side shell components, wherein the headgear comprises an open top through which a wearer's head may extend.

15. The headgear of claim 14 wherein the rear strap is attached to the side shell components via straps that are in-molded with the side shell components.

16. The headgear of claim 3 further comprising an upper protective component positioned above each side shell component and adjacent to the front shell component.

17. The headgear of claim 16 wherein each of the upper protective components is sewn to a comfort liner on an inner surface of the side shell components.

18. Sports headgear, comprising:

a front shell component comprising expanded polystyrene;

at least two side shell components comprising expanded polystyrene attached to the front shell component via straps;

at least one channel including angled corners in each of the front and side shell components, wherein each of the channels provides a fracture zone;

an external rear strap connecting the two side shell components to each other, the rear strap configured to engage the back of a wearer's head; and a temple guard comprising expanded polystyrene depending downwardly from each of the two side shell components.

19. Sports headgear, comprising:

a front shell component including a wearer-facing surface and an external surface, and at least one front internal channel in the front shell component that provides a fracture zone, wherein the front internal channel runs along the wearer-facing surface of the front shell component; and at least two side shell components attached to or integral with the front shell component, wherein the side shell components each include a wearer-facing surface and an external surface, and at least one side internal channel in each side shell component that provides a fracture zone, wherein each of the side internal channels runs along the wearer-facing surface of one of the side shell components.

* * * * *